US009841186B2

(12) United States Patent
Cho et al.

(10) Patent No.: US 9,841,186 B2
(45) Date of Patent: Dec. 12, 2017

(54) TUNABLE NUCLEATE BOILING USING ELECTRIC FIELDS AND IONIC SURFACTANTS

(71) Applicant: Massachusetts Institute of Technology, Cambridge, MA (US)

(72) Inventors: Han-Jae Jeremy Cho, Boston, MA (US); Evelyn N. Wang, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 196 days.

(21) Appl. No.: 14/568,927

(22) Filed: Dec. 12, 2014

(65) Prior Publication Data

US 2015/0167959 A1 Jun. 18, 2015

Related U.S. Application Data

(60) Provisional application No. 61/915,188, filed on Dec. 12, 2013.

(51) Int. Cl.

| | |
|---|---|
| ***H05B 3/60*** | (2006.01) |
| ***F23B 30/00*** | (2006.01) |
| ***H05B 3/80*** | (2006.01) |
| ***F24H 1/10*** | (2006.01) |

(52) U.S. Cl.

CPC ..... *F23B 1/30* (2013.01); *F24H 1/106* (2013.01); *H05B 3/80* (2013.01)

(58) Field of Classification Search

None

See application file for complete search history.

(56) References Cited

U.S. PATENT DOCUMENTS

| | | | | |
|---|---|---|---|---|
| 535,267 | A * | 3/1895 | Wagner et al. | C02F 1/46109 204/275.1 |
| 2,263,549 | A | 11/1941 | Peyches | |
| 2,493,923 | A | 1/1950 | Montone | |
| 2,680,802 | A * | 6/1954 | Bremer | A47J 31/40 222/129.1 |
| 2,836,699 | A * | 5/1958 | Mullin | F24H 1/106 392/318 |
| 3,666,917 | A * | 5/1972 | Oglesby | F24H 1/106 392/311 |
| 3,843,950 | A * | 10/1974 | Schladitz | F24H 1/101 219/552 |
| 3,867,610 | A * | 2/1975 | Quaintance | F24H 1/106 338/83 |

(Continued)

OTHER PUBLICATIONS

International Searching Authority, International Search Report—International Application No. PCT/US2014/070042, dated Apr. 1, 2015, together with the Written Opinion of the International Searching Authority, 15 pages.

*Primary Examiner* — Thor Campbell

(74) *Attorney, Agent, or Firm* — Sunstein Kann Murphy & Timbers LLP

(57) ABSTRACT

A tunable boiling system includes a fluid having a solvent and an ionic surfactant in the solvent, a counter electrode disposed within the fluid, and a working electrode having a surface in contact with the fluid. The system is configured to apply a voltage between the surface and the counter electrode in order to affect bubble formation in the fluid at the surface. Methods of making and using the system are also provided.

20 Claims, 11 Drawing Sheets

(56) References Cited

U.S. PATENT DOCUMENTS

| | | | | | |
|---|---|---|---|---|---|
| 3,925,638 | A * | 12/1975 | Scatoloni | F24H 1/106 | 204/196.05 |
| 4,119,833 | A * | 10/1978 | Welch | H05B 3/60 | 338/83 |
| 5,054,108 | A | 10/1991 | Gustin et al. | | |
| 5,156,706 | A | 10/1992 | Sephton | | |
| 5,222,185 | A * | 6/1993 | McCord, Jr. | F24H 1/106 | 219/601 |
| 5,583,960 | A * | 12/1996 | Reznik | A23B 5/01 | 219/771 |
| 5,636,317 | A * | 6/1997 | Reznik | A23B 5/01 | 392/312 |
| 5,863,580 | A * | 1/1999 | Reznik | A23B 5/01 | 426/237 |
| 6,130,990 | A * | 10/2000 | Herrick | H05B 3/60 | 392/312 |
| 6,421,501 | B2 * | 7/2002 | Berthou | H05B 3/60 | 165/167 |
| 6,522,834 | B1 * | 2/2003 | Herrick | H05B 3/60 | 222/251 |
| 7,050,706 | B2 * | 5/2006 | Israelsohn | F24H 1/106 | 392/314 |
| 8,565,588 | B2 * | 10/2013 | Bierbaumer | F24H 1/106 | 392/311 |
| 2011/0008026 | A1 | 1/2011 | Campbell | | |
| 2013/0089310 | A1 | 4/2013 | Wielstra | | |
| 2013/0315574 | A1 * | 11/2013 | Pain | A23L 3/005 | 392/314 |

* cited by examiner

TUNABLE NUCLEATE BOILING USING ELECTRIC FIELDS AND IONIC SURFACTANTS

CROSS-REFERENCE TO RELATED APPLICATIONS

This patent application claims the benefit of U.S. Provisional Patent Application No. 61/915,188 filed Dec. 12, 2013, the disclosure of which is incorporated by reference herein in its entirety.

STATEMENT REGARDING FEDERALLY SPONSORED RESEARCH OR DEVELOPMENT

This invention was made with Government support under Grant No. DMR-0819762 awarded by the National Science Foundation. The Government has certain rights in the invention.

TECHNICAL FIELD

The present invention relates to a boiling system, and more specifically to a tunable boiling system.

BACKGROUND ART

Technologies that utilize boiling have been essential in our daily lives whether it be in simple cooking devices or in power plants providing the majority of the world's electricity today. For decades, boiling research has primarily focused on static enhancements to surfaces and fluids by modifying wettability: the ability of liquids to spread on a surface, which is a behavior strongly linked to how easily bubbles can be generated. Typically, modifications either lower wettability (the ability of a liquid to spread on a surface) to create more bubbles and improve efficiency, or increase wettability to suppress bubble generation and maximize heat transfer Thus, boilers are typically designed for specific purposes with limited versatility.

Boiling is an energy intensive liquid to vapor phase change process that provides immense utility in a large portion of industrial and domestic applications. During boiling, bubbles nucleate from a solid-liquid interface and grow adhered to the surface by surface tension until external buoyancy and convection force them to depart from the surface. In pool boiling, no bulk movement of fluid is applied, and buoyancy is primarily involved in bubble departure.

For a given surface and fluid combination, the heat flux, q", is related to the wall superheat (difference between the surface temperature and boiling point), $T_{Wall}-T_{sat}$, according to a boiling curve. At any point along the curve, a heat transfer coefficient (HTC), $h_{boil}$, is defined as $$h_{boil} = \frac{q''}{T_{wall} - T_{sat}} \tag{1}$$

As the superheat increases, bubble nucleation increases until the critical heat flux (CHF) is reached. At the CHF, which is typically on the order of 100 W $cm^{-2}$ for water, coalescence of bubbles at the surface causes a vapor film to form that impedes the heat transfer. In this case, the heat transfer coefficient is lowered significantly due to a dramatic rise in temperature, which can be catastrophic. Consequently, maximizing the CHF is a common goal for boiling enhancement and is typically achieved by incorporating surface roughness with high wettability. This allows the liquid to easily rewet the surface after bubble departure, preventing bubble coalescence. However, highly wetting behavior suppresses nucleation compared to a non-wettable surface. The link between nucleation and wettability has been distinctly observed and explained. Thus, superheats are typically larger for highly wetting surfaces, which is non-ideal from an HTC and energy efficiency standpoint. Efforts to increase HTC include incorporating roughness and low wetting materials in order to promote nucleation. Adding surfactants, which are molecules with hydrophobic and hydrophilic components, at low concentrations have also increased the HTC consistent with decreased wettability. This result can be attributed to solid-liquid adsorption of additives, rendering the surface less wettable, which promotes nucleation, before dynamic liquid-vapor surface tension effects become apparent and increase wetting. Even with theses surface and fluid modifications, however, the behavior of the boiler is fundamentally the same: a static system where performance is locked to a fixed boiling curve.

SUMMARY OF EMBODIMENTS

In accordance with one embodiment of the invention, a tunable boiling system includes a fluid comprising a solvent and an ionic surfactant in the solvent, a counter electrode disposed within the fluid, and a working electrode having a surface in contact with the fluid. The system is configured to apply a voltage between the surface and the counter electrode in order to affect bubble formation in the fluid at the surface.

In accordance with another embodiment of the invention, a method of selectively boiling a fluid includes providing the tunable boiling system described above, and applying the voltage between the surface and the counter electrode in order to affect the bubble formation in the fluid at the surface.

In accordance with another embodiment of the invention, a method of forming a tunable boiling system includes providing a solvent, dissolving an ionic surfactant in the solvent to form a fluid, disposing a counter electrode within the fluid, placing a surface of a working electrode in contact with the fluid, and configuring the system so that a voltage is applied between the surface and the counter electrode in order to affect bubble formation in the fluid at the surface.

In some embodiments, the surface may include two or more electrically conductive areas so that the system applies the voltage between one or more of the electrically conductive areas and the counter electrode. The system may be configured to apply a negative voltage and/or a positive voltage between the surface and the counter electrode. The system may further include one or more heaters, configured to heat the fluid, in thermal contact with the working electrode and/or the fluid. The solvent may be deionized water. The ionic surfactant may be sodium dodecyl sulfate (SDS) or dodecyltrimethylammonium bromide (DTAB). The method may further include applying the voltage between a first electrically conductive area and the counter electrode and then applying the voltage between a second electrically conductive area and the counter electrode in order to affect the bubble formation in the fluid at different locations on the surface. The bubble formation may be increased or decreased with increasing negative voltage.

BRIEF DESCRIPTION OF THE DRAWINGS

The foregoing features of the invention will be more readily understood by reference to the following detailed description, taken with reference to the accompanying drawings, in which.

DESCRIPTION OF ILLUSTRATIVE EMBODIMENTS

Embodiments of the present invention provide a dynamic boiling system with a spatially and temporally tunable performance. The boiling approach can reversibly modulate wettability and bubble generation on demand in time and space, providing the ability to prioritize energy efficiency or maximum heat transfer at any point in time. An input (e.g., voltage) controls or turns on/off bubble nucleation at specifically designated areas and times thereby affecting heat transfer and steam generation. For example, temporal control may be achieved by applying a small voltage between a plain metal boiling surface and a separate electrode immersed in a liquid, e.g., water, with a small amount of commonly available surfactant. Spatial control may be achieved on designated areas via spatially defined electrodes on the boiling surface where bubble generation can be rapidly switched on and off. The ability to tune boiling performance both temporally and spatially provides additional fine manipulation capability within existing boiling technologies to provide more optimal performance. In addition, this approach can aid development of emerging or unprecedented boiling applications such as electronics cooling, distributed power stations, automotive heat recovery, among others, where boilers must accommodate a range of operating conditions to provide optimal performance. Details of illustrative embodiments are discussed below.

Figure 2:
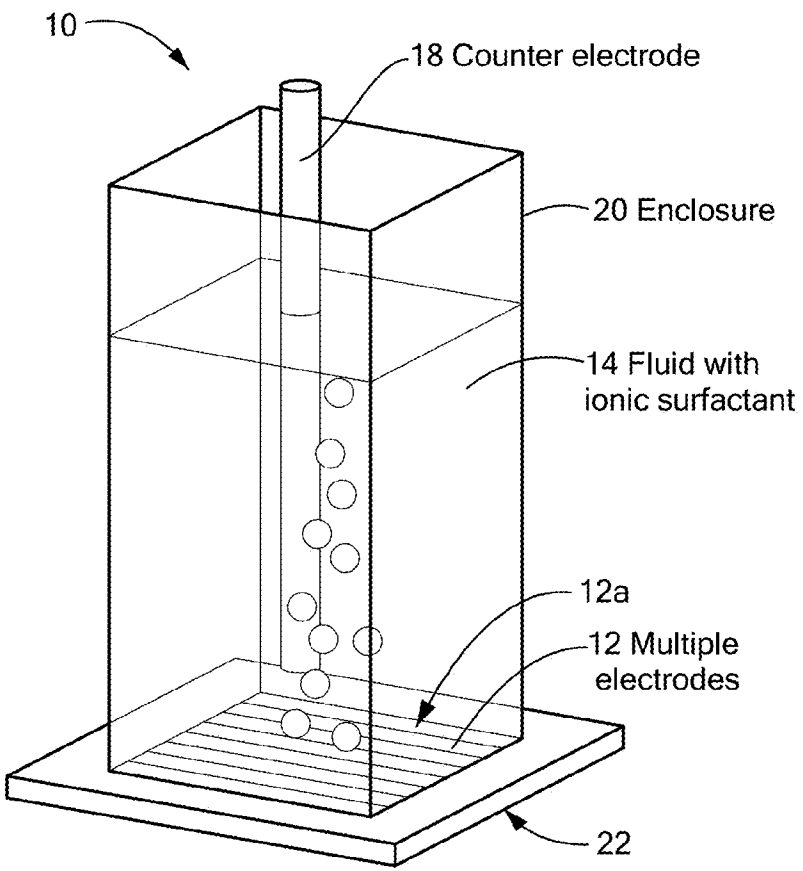
FIG. 2 schematically shows a tunable boiling system with several electrodes on a working electrode according to embodiments of the present invention.
Figure 1:
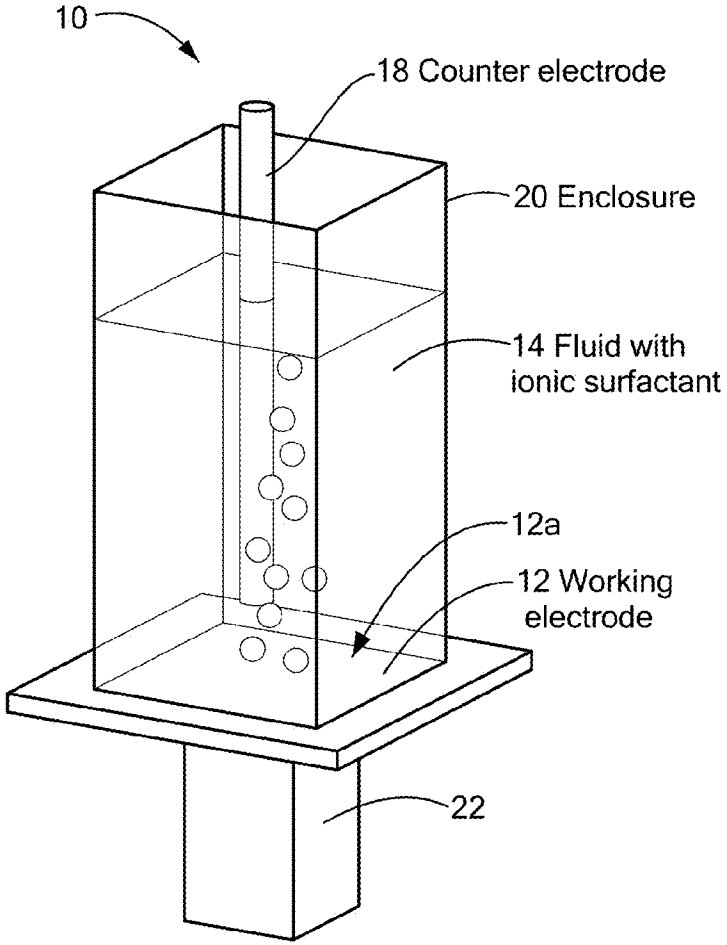
FIG. 1 schematically shows a tunable boiling system according to embodiments of the present invention.

FIG. 1 shows a tunable boiling system 10 according to embodiments of the present invention. The system includes a working electrode 12 having a surface 12*a* in contact with a fluid 14. The fluid is a solvent, such as deionized water, with an ionic surfactant in the solvent. The ionic surfactant is provided in small concentrations, e.g., on the order of a few mM, so as not to affect the bulk properties of the fluid, other than surface tension. A counter electrode 18 is disposed within the fluid 14. The system 10 is configured to apply a voltage between the surface 12*a* of the working electrode 12 and the counter electrode 18 in order to affect bubble formation in the fluid at the surface. This configuration allows a change in the HTC and/or CHF due to the application or modification of the electric field at the surface which promotes or suppresses the boiling of the fluid.

The working electrode 12 may have one electrode or electrically conductive area on its surface 12*a*, such as shown in FIG. 1, or may include several electrodes or electrically conductive areas on its surface 12*a*, such as shown in FIG. 2 and FIGS. 8A-8E (described in more detail below). For example, the surface may include two or more electrically conductive areas separated by nonconductive areas so that the system applies the voltage between one or more of the electrically conductive areas and the counter electrode.

Figure 6:
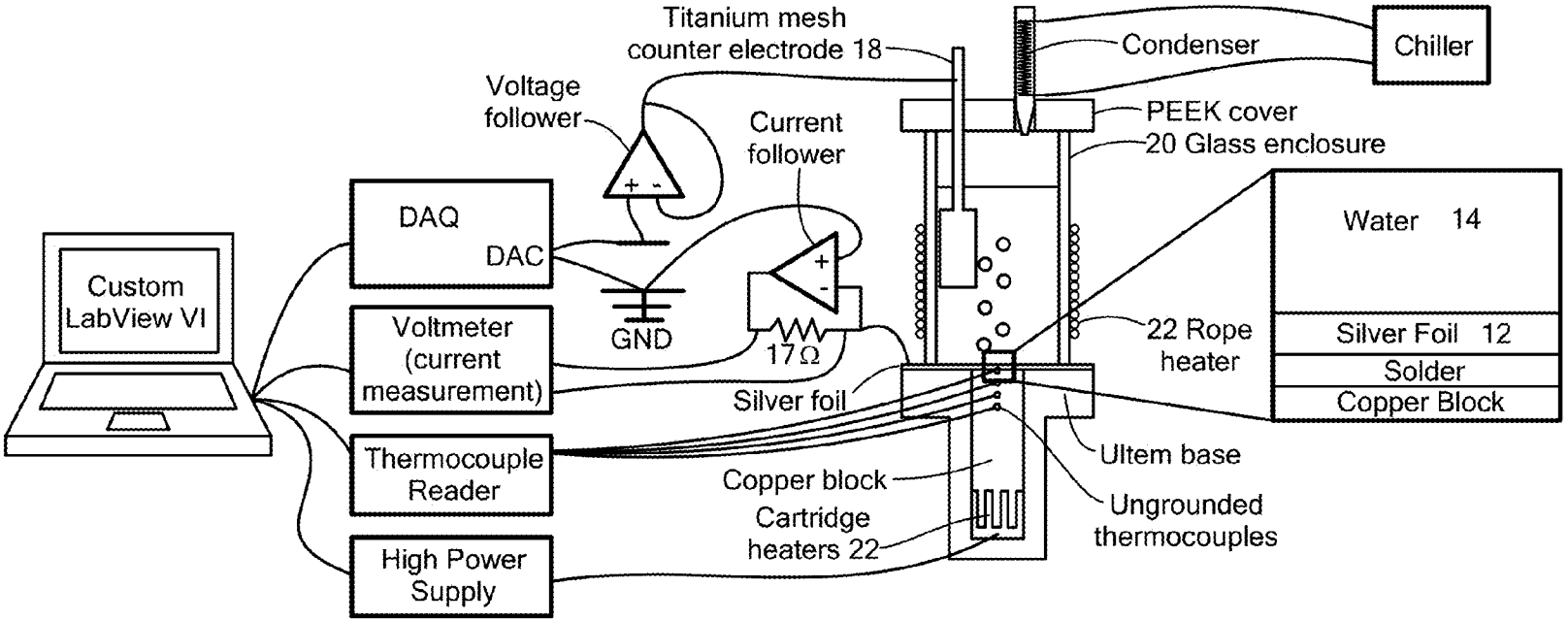
FIG. 6 schematically shows the tunable boiling system used in FIGS. 3A-3D, 4A-4D, 5A-5D, and 7A-7B according to embodiments of the present invention.
Figure 9:
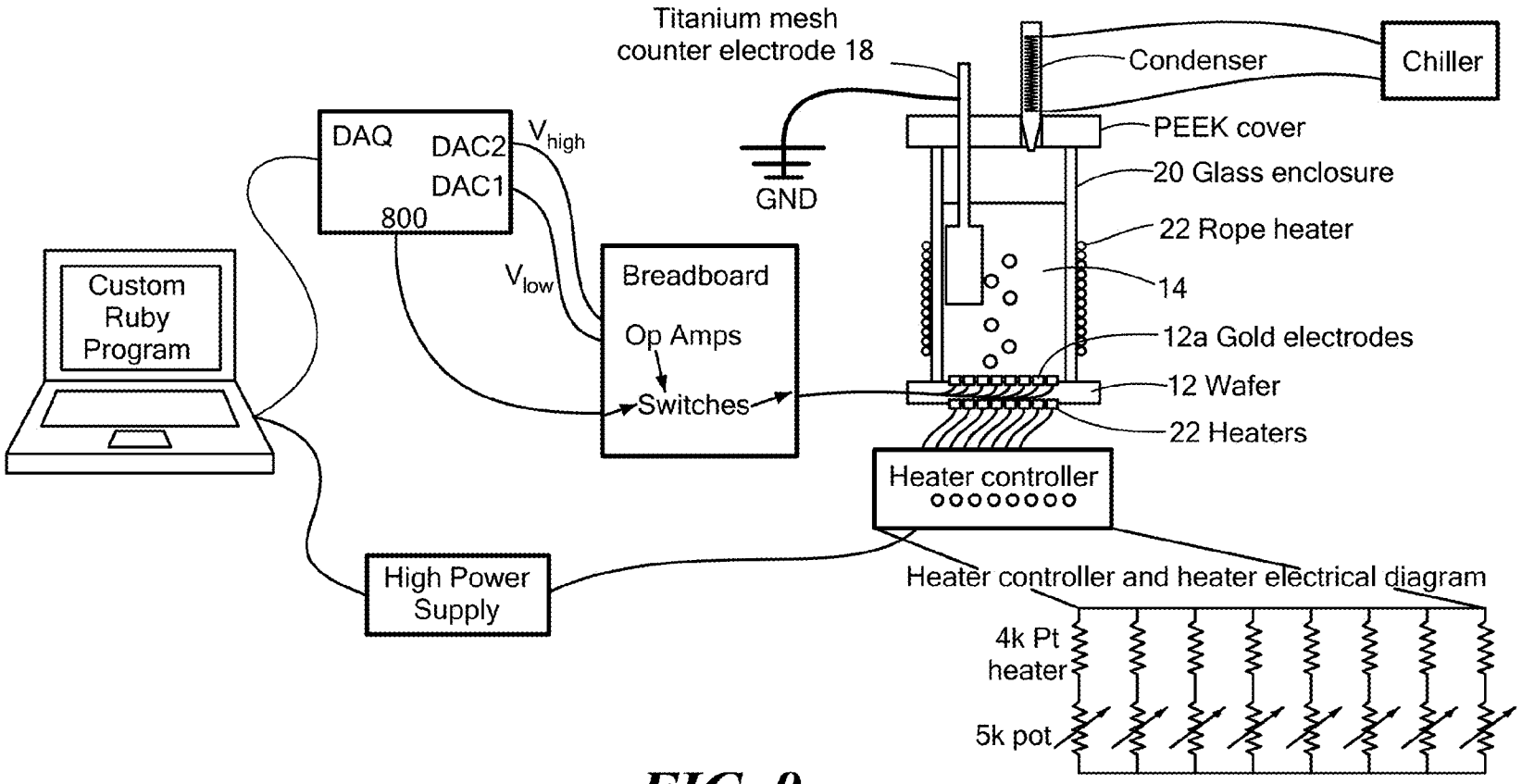
FIG. 9 schematically shows the tunable boiling system used in FIGS. 8A-8E according to embodiments of the present invention.

The system 10 may include an enclosure 20 which holds the fluid 14 within it and allows the working electrode 12 and counter electrode 18 to be in contact with the fluid 14. In addition, the system 10 may include one or more heaters 22 disposed on the walls of the enclosure 22 (such as shown in FIGS. 6 and 9 discussed below), disposed under the working electrode 12, or both, in order to heat the surface 12*a* and/or the fluid 14.

The system is configured 10 to ensure that no significant chemical (Faradaic) reactions occur between the surface 12*a* of the working electrode 12 and the counter-electrode 18 within the voltage range applied. The system 10 is preferably configured as a capacitive/polarizable system with minimal charge transfer across the solid-liquid interface. In order to maximize the capacitance (adsorption of surfactant) at the surface of the working electrode 12, the counter electrode 18 preferably has a much higher surface area than the surface area of the working electrode 12.

Surfactant solutions below the critical micelle concentration (CMC) are monomeric (single molecules without aggregations) while above the CMC, surfactants aggregate into micelles. The CMC is typically a very small concentration on the order of a few mM; therefore, below the CMC many bulk properties such as viscosity, thermal conductivity, specific heat, and saturation temperature are virtually unaffected. On the other hand, surface tension is significantly reduced due to the tendency of surfactants to adsorb at interfaces. In embodiments of the present invention, surfactant concentrations are submicellar ($C_1 < C_{CMC}$). Thus, all fluid properties except for surface tension may be assumed to be invariant with surfactant concentration.

The materials used for the working electrode may vary depending on the solvent, ionic surfactant and voltages used. For example, gold, silver, copper, titanium, and aluminum may be acceptable materials, as well as others. In one embodiment, titanium may be used as the working electrode 12, 314 stainless steel mesh for the counter electrode 18, deionized water for the solvent, and either SDS or DTAB as the charged or ionic surfactant. Electrochemical considerations and testing may be required to determine a suitable voltage range for a given set of materials. For example, a $V_{cell}$ range of −0.1 V to −2.0 V may be used to ensure that the working electrode (boiling surface) is being reduced as opposed to being oxidized for silver-titanium and gold-titanium electrochemical systems. Reduction ensures that a pristine metal surface is maintained, which could also be useful in maintaining the quality of the boiling surfaces in practice. Although embodiments may be configured to apply positive voltages with beneficial, tunable results, the boiling surface may become oxidized. Embodiments may also apply voltages greater in magnitude than −2.0 V, in the example given above, but bubbles may be spontaneously formed when $T_{wall}<T_{sat}$ which indicates the presence of electrolysis that directly increases nucleation density. However, using electrolysis to open up nucleation sites may be an additional useful active method of boiling enhancement at the cost of replenishing lost water and venting generated hydrogen and oxygen gas.

Embodiments of the present invention allow adsorption of surfactants to the surface in order to activate or suppress bubble nucleation, which affects boiling heat transfer performance. With active tunable boiling, either higher HTC or higher CHF may be selected, two characteristics that are typically impossible to achieve on the same boiling surface. A higher degree of tunability may be further possible by engineering a boiling surface with nucleation sites that can be more easily activated and deactivated. One method of achieving this may be to introduce more cavities to the surface by roughening. In addition, a different electrode material system may offer a larger voltage window free of Faradaic reactions allowing larger voltages to be applied to cause larger changes in HTC. Different solvents, such as acetone, may also be used to allow larger voltages since electrolysis (electrochemical decomposition of the fluid) can be avoided.

Embodiments of the present invention allow boiling curves to be shifted, e.g., superheat can be minimized and efficiency maximized or CHF protection can be prioritized. The ability to move the boiling curve can transcend the traditional application of boilers, phase change coolers, and other devices. This behavior may be due to surfactant adsorption to the surface rendering the surface more hydrophobic and promoting nucleation, and this concept can aid in determining more ideal surfactants for boiling applications. In addition, embodiments provide a tunable boiling system that allows spatial and temporal control, which is an important evolutionary step in boiling technology. Such capability allows for a higher degree of optimization whether it is in existing systems, such as power plants and HVAC, or in emerging and still unrealized applications, such as electronics hot spot cooling or small scale combined heat and power devices. In addition, embodiments provide significant results with no difficult fabrication methods or rare materials, so the system is relatively simple to implement on a large scale.

EXAMPLES

A set of experiments were run to prove the viability of the tunable boiling system configuration according to embodiments of the present invention. In all tests, 400 mL of deionized (DI) water is brought to saturation conditions and additives (DTAB, SDS, NaBr, MEGA-10) prepared at a concentration of 173 mM were added to the DI water to bring the concentration to 2.6 mM. The surfactant properties are listed below in Table 1.

TABLE 1

| Surfactant | Charge | Tail length (# of carbons) | CMC in water at 100° C. (mM) |
|---|---|---|---|
| MEGA-10 | 0 | 10 | 4.1 ± 1.5 |
| DTAB | +1 | 12 | 13.9 |
| SDS | −1 | 12 | 10.4 |

Sodium Dodecyl Sulfate (SDS) is a negatively charged or anionic surfactant with a 12-carbon long hydrophobic tail, a hydrophilic sulfate head, and a sodium counterion. Dodecyltrimethylammonium Bromide (DTAB) is a positively charged or cationic surfactant with the same 12-carbon long hydrophobic tail, a hydrophilic ammonium head, and a bromide counterion. To further prove that adsorbed surfactants were responsible for the boiling tunability, controlled boiling experiments were also performed using a simple salt, NaBr, and a nonionic surfactant, MEGA-10, in addition to SDS and DTAB. NaBr is a salt composed of the counterions of SDS and DTAB.

FIGS. 3A through 3D are boiling curves for NaBr, MEGA-10, DTAB, and SDS solutions, respectively, at a concentration of 2.6 mM on a roughened silver boiling surface. The cell voltage was fixed while the heater power was varied in a quasi-static manner allowing the relationship between heat flux and superheat (boiling curve) to be plotted. Separate boiling curves were attained for different voltages and additives. Plain deionized (DI) water boiling curve is plotted with a solid black line for comparison. For each solution, two voltages were plotted: −0.1 V and −2.0 V. The boiling curve of the NaBr and MEGA-10 solution was not observed to significantly change with voltage, thus indicating that heat transfer is not affected by applied cell voltage. Furthermore, no significant change in nucleation behavior was observed for NaBr and MEGA-10 while changes were observed for SDS and DTAB (as shown in FIGS. 4A-4D and 5A-5D and FIGS. 8A-8E discussed below).

Figure 3A:
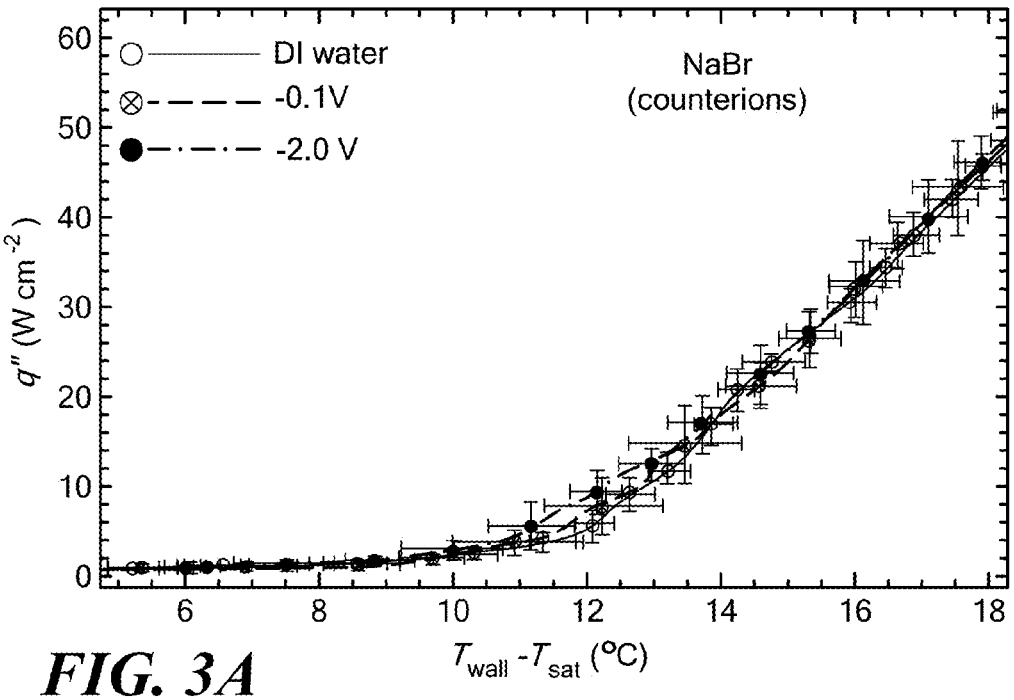
FIGS. 3A and 3B are graphs showing the boiling curves for two solutions used as controls.
Figure 3B:
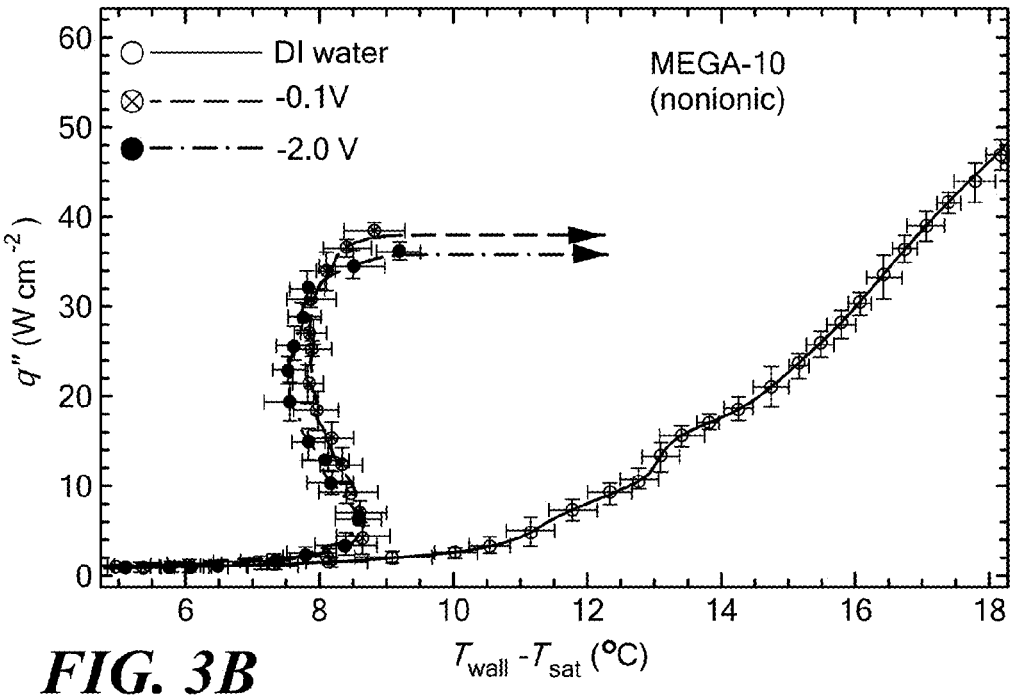
Figure 3C:
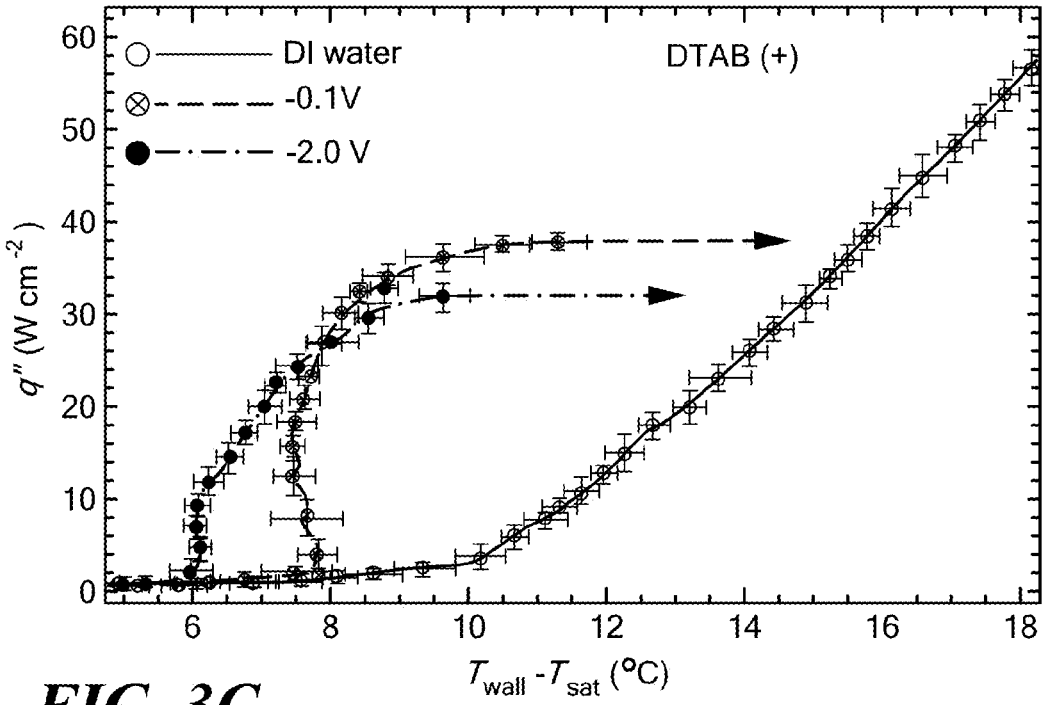
FIGS. 3C and 3D are graphs showing the boiling curves for two solutions formed according to embodiments of the present invention.
Figure 3D:
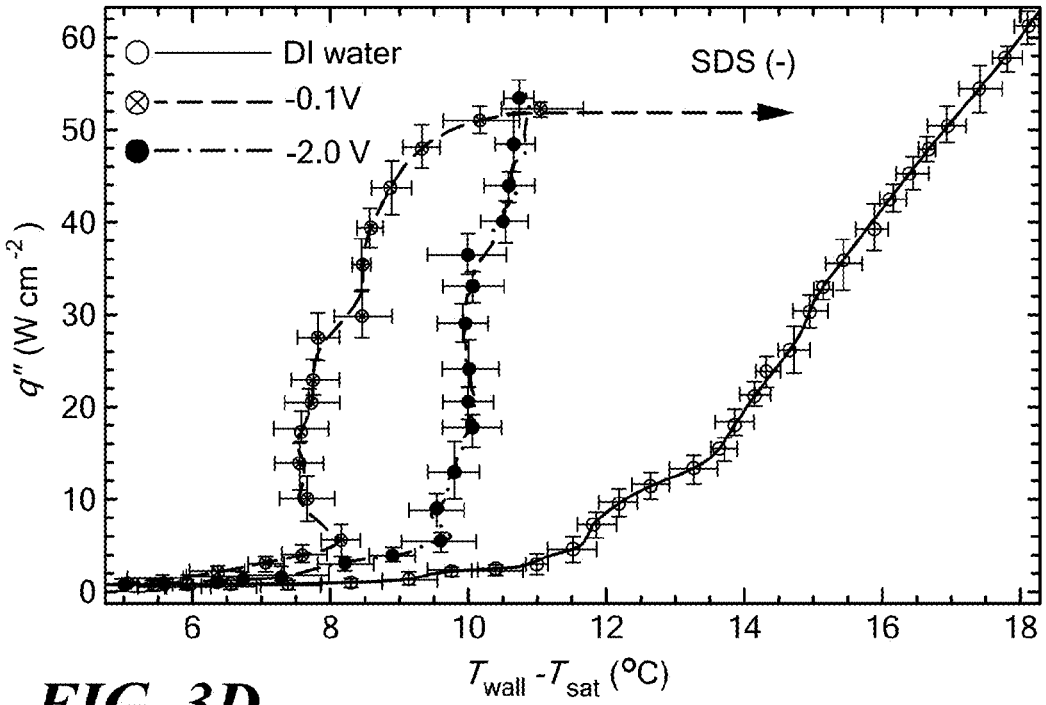
Figures 4A, 4B, 4C, 4D, 5A, 5B, 5C, 5D:
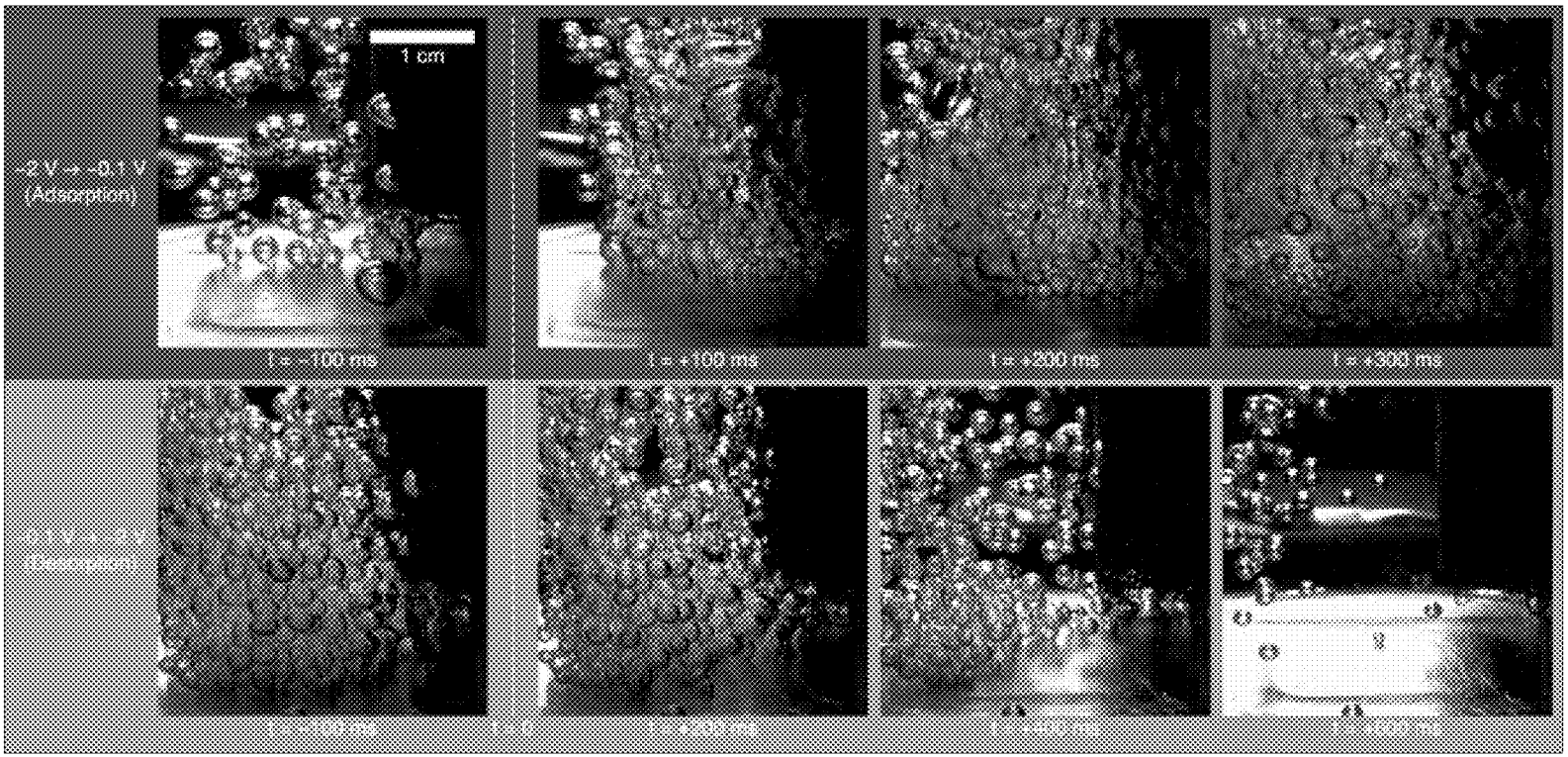
FIG. 4A is a photograph showing bubble formation at −2.0 V.
FIGS. 4B through 4D are photographs showing an increase in bubble formation over time in response to a −2.0 V to −0.1 V voltage change.
FIG. 5A is a photograph showing bubble formation at −0.1 V.
FIGS. 5B through 5D are photographs showing a decrease in bubble formation over time in response to a −0.1 V to −2.0 V voltage change according to embodiments of the present invention.

For all surfactant solutions, boiling curves were shifted to the left compared to DI water due to increased nucleation with lower CHF. For positively charged DTAB, applying a more negative potential shifted the boiling curve to the left compared to the baseline −0.1 V curve, increasing HTC, as shown in FIG. 3C, which corresponds to HTC increasing with surfactant adsorption. The CHF for DTAB decreased with more negative voltage likely due to decreased wettability of the surface. For negatively charged SDS, the boiling curves shifted to the right compared to the baseline −0.1 V curve and CHF increased with more negative voltage, as shown in FIG. 3D, which corresponds to HTC decreasing with surfactant desorption.

FIGS. 4A-4D and 5A-5D show photographs of a silver foil boiling system with a negatively charged SDS solution before and after a change in voltage. FIG. 6 shows a schematic of the experimental set up. The main components include a copper heating block, cartridge heaters, guard heaters, boiling surface, glass enclosure, titanium counter electrode, Ultem casing, and a condenser powered by Neslab RTE-111 chiller that keeps the system closed loop. The copper block had a cross-sectional area of 4 $cm^2$ and had four thermocouples equally spaced 8 mm apart to determine the heat flux, and holes drilled on the bottom that were filled with cartridge heaters powered by a Kepco KLP 600-4 power supply. The foil was roughened with 240 grit sandpaper and soldered to the copper block. Voltage between the foil and counter electrode was applied by a voltage follower op amp and current was measured using a current follower op amp. A DAC attached to a DAQ (LabJack U3-HV) provided the input signal for voltage and a multimeter (Keithley 2001) measured the voltage across the current follower to measure current. Since some voltage was lost across the op amp inputs, the cell voltage was monitored by a separate multimeter (Agilent 34401A) and a custom LabView program with a control loop to maintain a desired voltage was utilized. In FIGS. 4A-4D, a −2.0 V to −0.1 V transition caused adsorption of surfactant and significant increase in nucleation was observed within 300 ms. In FIGS. 5A-5D, a −0.1 V to −2.0 V transition caused desorption of surfactant and significant decrease in nucleation was observed within 600 ms.

Figure 7A:
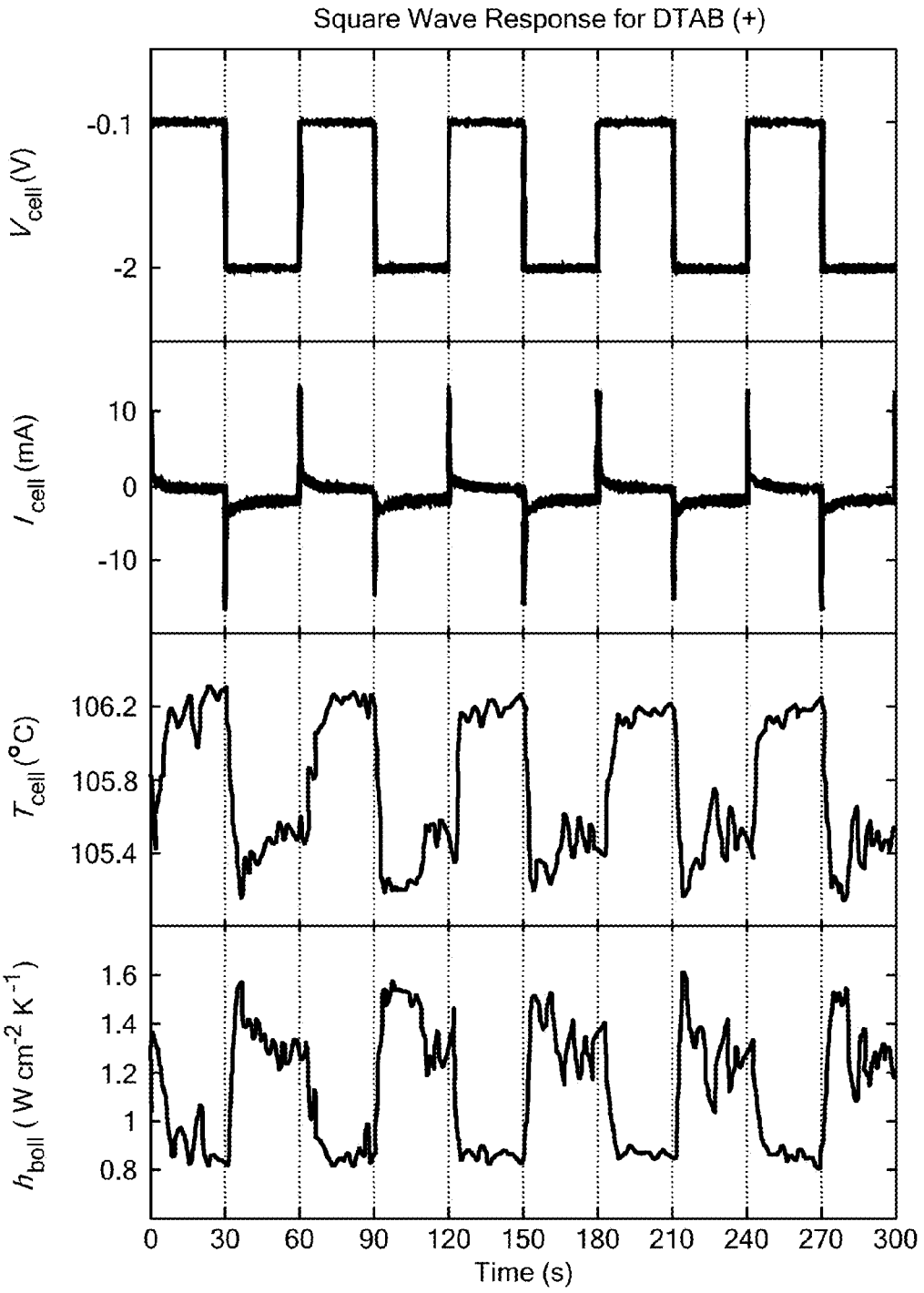
FIGS. 7A and 7B are graphs showing square wave response in surface temperature and heat transfer coefficient for two ionic surfactants according to embodiments of the present invention.
Figure 7B:
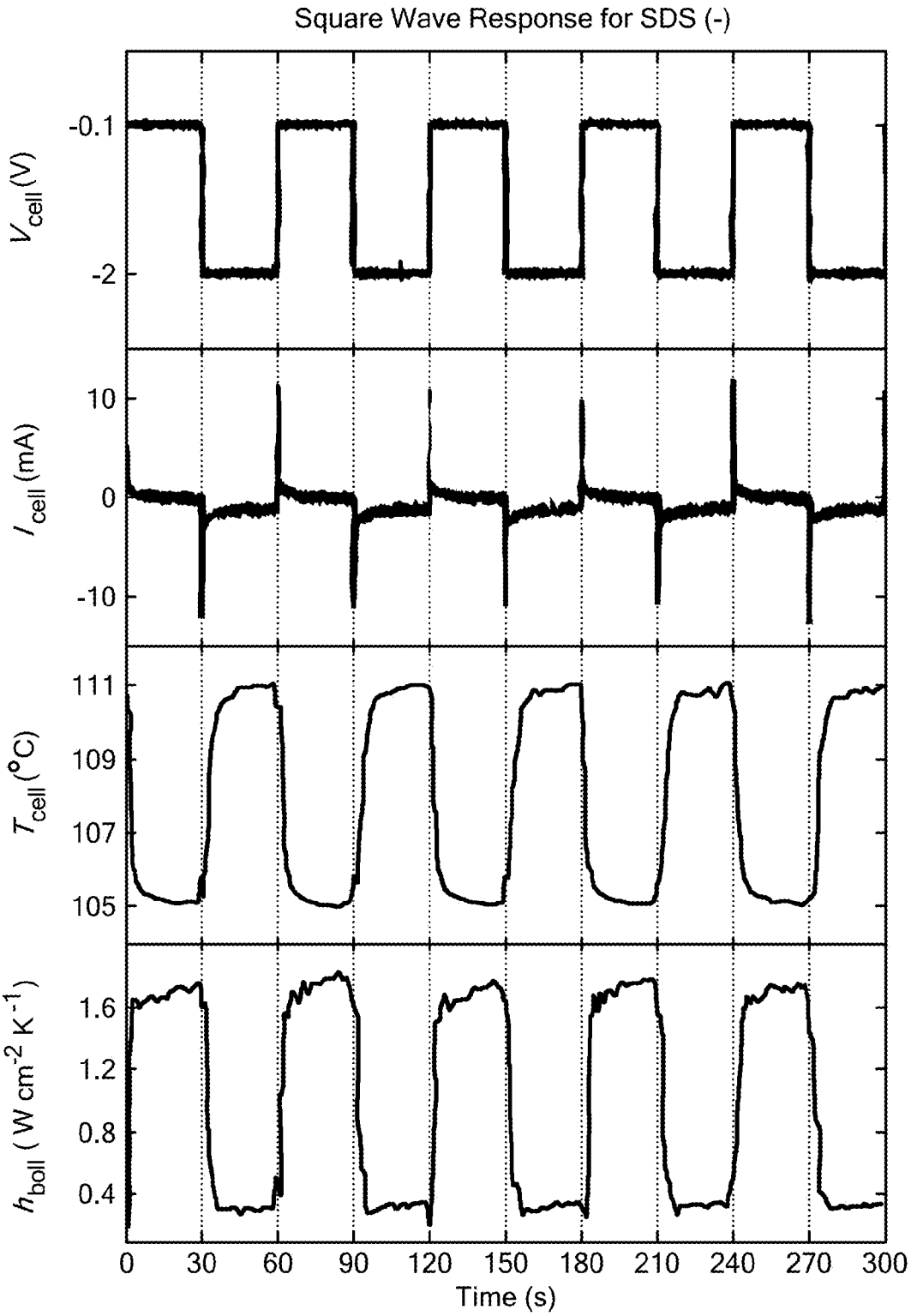

Using the silver foil boiling system set up of FIG. 6, a square wave voltage was applied across the surface of the working electrode and counter electrode during nucleate pool boiling. The thermal response to changes in bubble nucleation from a changing voltage were quantified using embedded thermocouples under the boiling surface, which enabled measurement of surface temperature and heat flux. With 60 W of heating power, a square wave potential was applied between −0.1 V and −2.0 V with a period of 60 s, and square-like responses in temperature and heat flux were obtained for two charged surfactants, as shown in FIGS. 7A and 7B. For DTAB, the surface temperature change was in-phase with voltage while HTC was out-of-phase, as shown in FIG. 7A. SDS had the opposite response. For SDS, the surface temperature change was out-of-phase with voltage and HTC was in-phase, as shown in FIG. 7B. This is consistent with the fact that DTAB and SDS should respond oppositely to the electric field due to their opposite charges. Thus, for negatively charged or anionic SDS, HTC increased with more positive voltage and decreased with more negative voltage. For positively charged or cationic DTAB, HTC decreased with more positive voltage and increased with more negative voltage. These results show that for both DTAB and SDS, HTC increases with increasing surfactant adsorption. For NaBr, no statistically significant increase or decrease in HTC was observed during a square wave voltage. This indicates that surfactant adsorption from an applied electric field is responsible for the boiling HTC change. Switching from −0.1 V and −2 V, the heat transfer coefficient for SDS could be decreased by approximately 75% while for DTAB the heat transfer coefficient could be increased by approximately 50%. In both cases, the current had a decaying response indicating capacitive behavior with a steady state current less than 0.1 mA $cm^{-2}$.

FIGS. 8A-8E are photographs showing spatially controlled boiling of 2.6 mM DTAB on a surface patterned with a 1D array of gold electrodes in a tunable boiling system formed according to embodiments of the present invention. FIG. 9 shows a schematic of the experimental set up, which was similar to the FIG. 6 configuration, except for the multiple electrodes and heaters in the working electrode and the surfactant used. The spatially controlled boiling surface was created on a silicon wafer (150 mm diameter, 0.5 mm thickness) with a 1 μm thermal oxide layer. An aluminum shadow mask with slots cut out for electrodes 1 cm in width was created by waterjet and placed on top of the silicon wafer. The wafer was then sputtered with 100 nm of titanium for adhesion and 500 nm of gold electrode material. These formed eight separated gold electrodes which were heated by eight separate platinum resistive heaters formed on the backside of the wafer. Each strip had its own independent heater that could be controlled so as to ensure the entire surface was uniformly heated near the bubble nucleation onset point, which was approximately 1.5 W $cm^{-2}$. Each electrode could be switched between −2.0V and −0.1V which was set using two DACs on the DAQ and subsequently inverted using two inverting op amps. For each electrode, voltage was selected using an SPDT switch which was controlled by a digital out channel from the DAQ. Heaters were controlled using 5 k potentiometers in series. Each heater-pot line was connected in parallel to the high power supply.

Figures 8A, 8B:
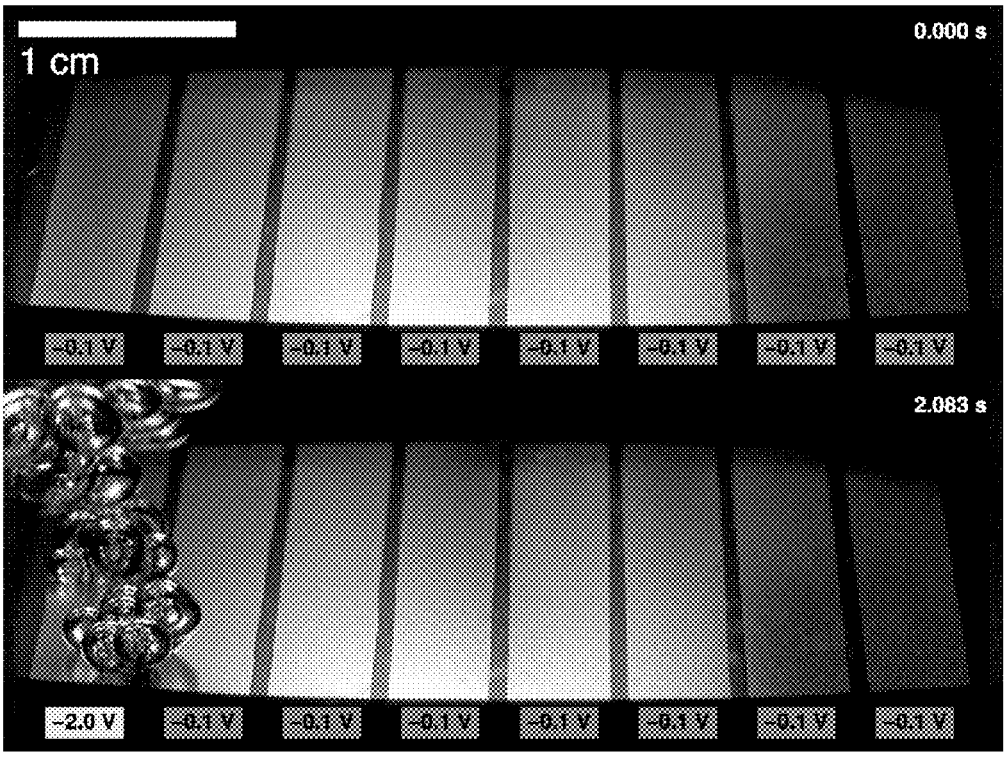
FIGS. 8A through 8E are photographs showing spatially controlled boiling with a surface patterned with a one-dimensional array of electrodes in a tunable boiling system according to embodiments of the present invention.
Figures 8C, 8D:
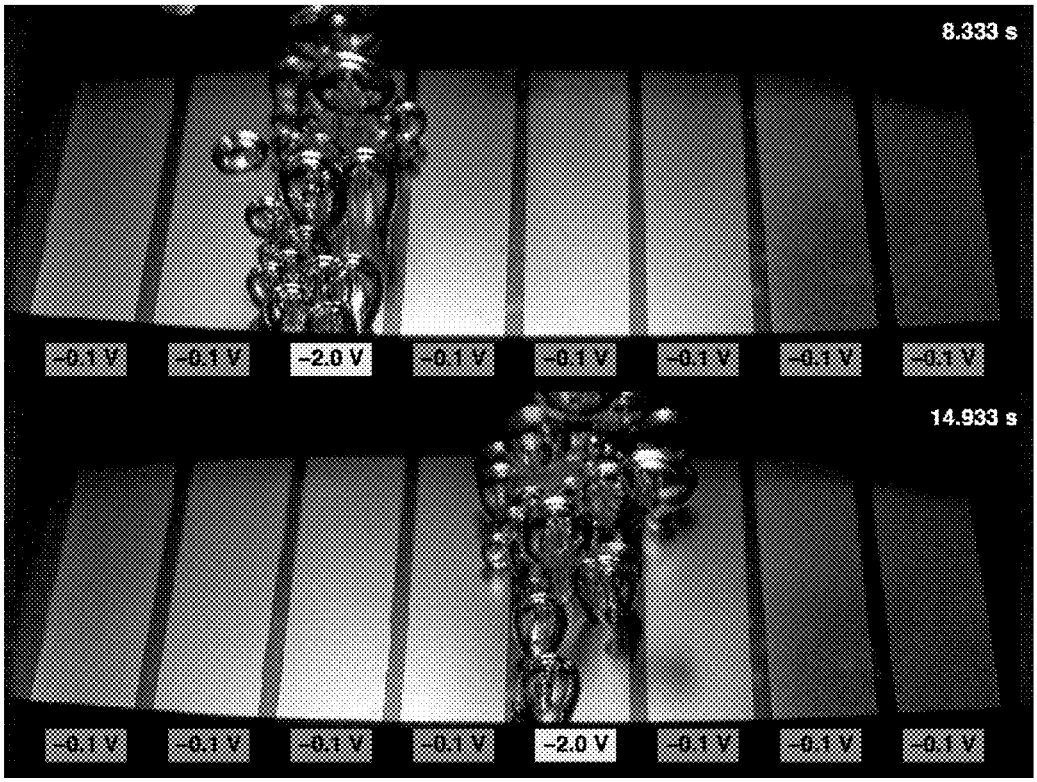
Figure 8E:
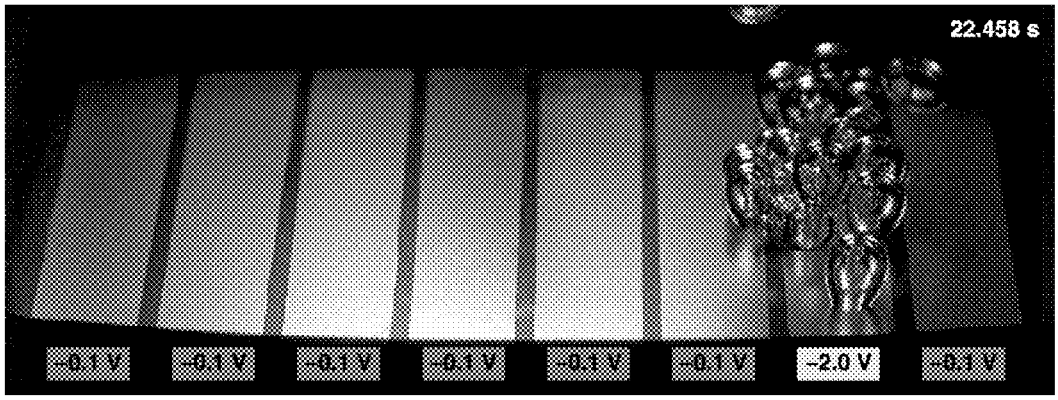

As shown in FIGS. 8A-8E, bubble nucleation was independently turned on and off by changing the voltage between the surface of the separated gold electrodes and a titanium counter electrode ($V_{cell}=V_{surface}-V_{counter}$). In FIG. 8A, no working electrodes are activated (voltage at −0.1 V). In FIGS. 8B-8E, a different electrode was activated (voltage changed to −2.0 V) and an increase in bubble nucleation was observed. DTAB, which is positively charged, was expected to be attracted to the surface when a more negative voltage was used. This renders the surface more hydrophobic and increases nucleation, which was confirmed by FIGS. 8B-8E. By doing so, bubble nucleation was completely suppressed and activated in a rapid manner at any point on the surface where the applied voltage was changed. This simple experiment showed that adsorption of surfactants to the surface can be directly responsible for bubble nucleation, and that accurate spatial control on the scale of a few millimeters is possible.

Although the above discussion discloses various exemplary embodiments of the invention, it should be apparent that those skilled in the art may make various modifications that will achieve some of the advantages of the invention without departing from the true scope of the invention.

What is claimed is:

1. A tunable boiling system comprising:

a fluid comprising a solvent and an ionic surfactant in the solvent;

a counter electrode disposed within the fluid;

a working electrode having a surface in contact with the fluid, the system configured to cause adsorption or desorption of the surfactant to the surface in order to shift a boiling curve of the fluid by applying a voltage between the surface and the counter electrode which activates or suppresses bubble formation in the fluid at the surface, and one or more heaters, configured to heat the fluid to or near a boiling point of the fluid, in thermal contact with the working electrode, the fluid, or both.

2. The system of claim 1, wherein the surface includes two or more electrically conductive areas, and the system is configured to apply the voltage between one or more of the electrically conductive areas and the counter electrode.

3. The system of claim 1, wherein the system is configured to apply a negative voltage between the surface and the counter electrode.

4. The system of claim 1, wherein the solvent is deionized water.

5. The system of claim 1, wherein the ionic surfactant is sodium dodecyl sulfate or dodecyltrimethylammonium bromide.

6. The system of claim 1, wherein the system is configured to cause adsorption or desorption of the surfactant to the surface which activates or suppresses bubble formation in the fluid at the surface in less than one minute at the saturation conditions.

7. A method of selectively boiling a fluid, the method comprising:

providing the tunable boiling system of claim 1;

heating the fluid with the one or more heaters; and applying the voltage between the surface and the counter electrode in order to cause the adsorption or desorption of the surfactant to the surface which activates or suppresses the bubble formation in the fluid at the surface.

8. The method of claim 7, wherein the surface includes two or more electrically conductive areas, and applying the voltage includes applying the voltage between one or more of the electrically conductive areas and the counter electrode.

9. The method of claim 8, wherein applying the voltage includes applying the voltage between a first electrically conductive area and the counter electrode and then applying the voltage between a second electrically conductive area and the counter electrode in order to activate or suppress the bubble formation in the fluid at different locations on the surface.

10. The method of claim 7, wherein the bubble formation is increased with increasing negative voltage.

11. The method of claim 7, wherein the bubble formation is decreased with increasing negative voltage.

12. The method of claim 7, wherein the solvent is deionized water.

13. The method of claim 7, wherein the ionic surfactant is sodium dodecyl sulfate or dodecyltrimethylammonium bromide.

14. The method of claim 7, wherein the system is configured to cause adsorption or desorption of the surfactant to the surface which activates or suppresses bubble formation in the fluid at the surface in less than one minute at the saturation conditions.

15. A method of forming a tunable boiling system, the method comprising:

providing a solvent;

dissolving an ionic surfactant in the solvent to form a fluid;

disposing a counter electrode within the fluid;

placing a surface of a working electrode in contact with the fluid;

providing one or more heaters in thermal contact with the working electrode, the fluid, or both, the one or more heaters configured to heat the fluid to or near a boiling point of the fluid; and configuring the system to apply a voltage between the surface and the counter electrode to cause adsorption or desorption of the surfactant to the surface which activates or suppresses bubble formation in the fluid at the surface.

16. The method of claim 15, wherein the surface includes two or more electrically conductive areas, and the system is configured to apply the voltage between one or more of the electrically conductive areas and the counter electrode.

17. The method of claim 15, wherein the system is configured to apply a negative voltage between the surface and the counter electrode.

18. The method of claim 15, wherein the solvent is deionized water.

19. The method of claim 15, wherein the ionic surfactant is sodium dodecyl sulfate or dodecyltrimethylammonium bromide.

20. The method of claim 15, wherein the system is configured to cause adsorption or desorption of the surfactant to the surface which activates or suppresses bubble formation in the fluid at the surface in less than one minute at the saturation conditions.

* * * * *